United States Patent [19]

Benedict et al.

[11] Patent Number: 4,771,899

[45] Date of Patent: Sep. 20, 1988

[54] CLOTHING ACCESSORY RACK

[75] Inventors: Charles E. Benedict; Judith B. McGinnis, both of Tallahassee, Fla.

[73] Assignee: Benedict Engineering Co., Inc., Tallahassee, Fla.

[21] Appl. No.: 149,908

[22] Filed: Jan. 22, 1988

Related U.S. Application Data

[63] Continuation of Ser. No. 06/890,306, Jul. 29, 1986, abandoned.

[51] Int. Cl.[4] ..... A47F 7/00

[52] U.S. Cl. ..... 211/60.1; 211/94; 211/105.3

[58] Field of Search ..... 211/60.1, 113, 119, 211/105.3, 94.5, 94, 162, 181, 46; D6/328, 324

[56] References Cited

U.S. PATENT DOCUMENTS

| | | | |
|---|---|---|---|
| D. 277,248 | 1/1985 | Benedict | D6/324 |
| D. 277,436 | 2/1985 | Benedict | D6/315 |
| D. 280,045 | 8/1985 | Benedict | D6/328 |
| D. 280,046 | 8/1985 | Benedict | D6/328 |
| D. 280,047 | 8/1985 | Benedict | D6/328 |
| D. 280,048 | 8/1985 | Benedict | D6/328 |
| D. 280,049 | 8/1985 | Benedict | D6/328 |
| D. 280,785 | 10/1985 | Benedict | D6/324 |
| 1,981,510 | 11/1934 | Jones | 211/94 |
| 2,569,761 | 10/1951 | Hibbs | 211/1.3 |
| 2,917,185 | 12/1959 | Kovacs | 211/94 |
| 2,985,311 | 5/1961 | Abel | 211/94 |
| 3,124,253 | 3/1964 | Petrich | 211/94 |
| 3,160,279 | 12/1964 | Hovey | 211/86 |
| 3,252,583 | 5/1966 | Walther et al. | 211/119 |
| 3,335,872 | 8/1967 | Dodich | 211/94 |
| 3,389,807 | 6/1968 | Manning et al. | 211/94 |
| 3,897,122 | 7/1975 | McEvers | 312/321 |
| 3,954,182 | 5/1976 | McEvers | 211/94 |
| 4,585,127 | 4/1986 | Benedict | 211/94 |

*Primary Examiner*—Ramon S. Britts
*Assistant Examiner*—Sarah A. Lechok Eley
*Attorney, Agent, or Firm*—Dowell & Dowell

[57] ABSTRACT

An accessory rack for storing a plurality of articles such as wearing apparel or clothing accessories including jewelry, scarfs, ties, belts, chains, handbags, beads and the like and which includes a plurality of generally C-shaped hooks which are suspended from a telescoping housing so as to provide upper and lower rows of horizontally oriented and spaced support bars upon which such articles may be selectively and securely supported.

12 Claims, 2 Drawing Sheets

Fig. 2
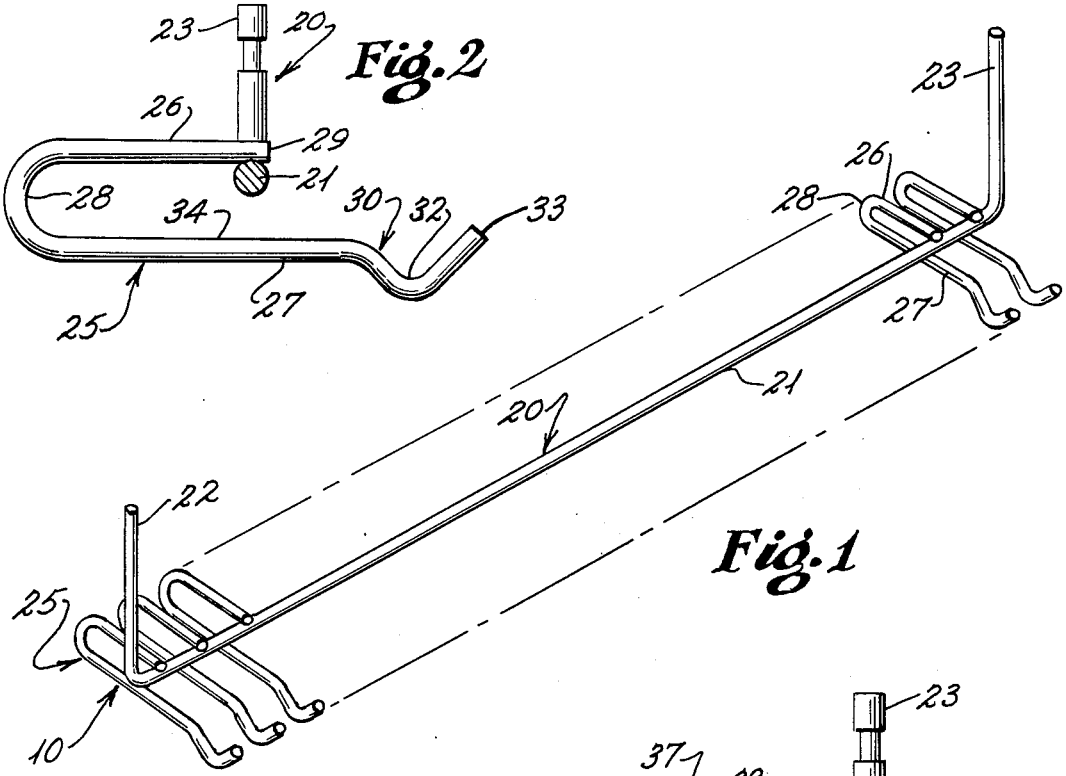
Fig. 1
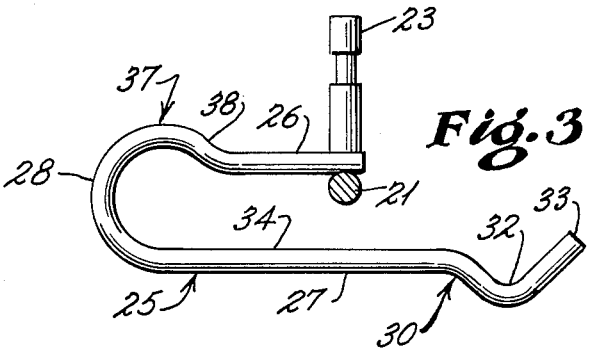
Fig. 3
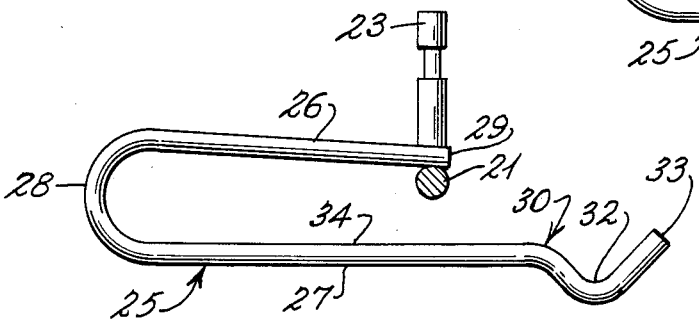
Fig. 4
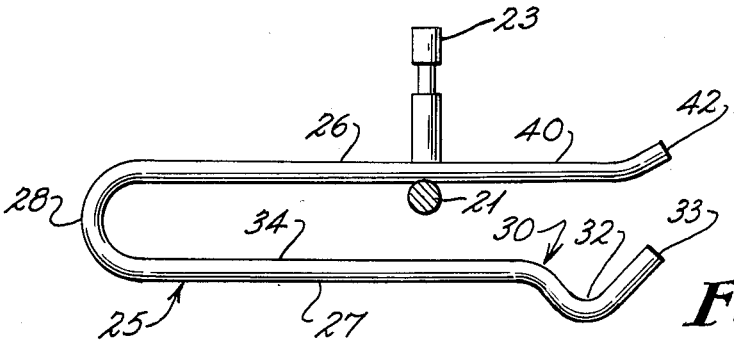
Fig. 5

CLOTHING ACCESSORY RACK

BACKGROUND OF THE INVENTION

1. Field of the Invention

This invention is generally related to clothing and article support racks or organizers and more specifically, to racks for supporting a plurality of articles or clothing accessories including such items as scarfs, ties, belts, handbags or purses, necklaces, chains and the like and which is constructed in such a manner as to provide a plurality of support rods for accomodating varying sizes and types of such articles wherein the support rods are configured so as to prevent accidental displacement of the articles carried thereon. In addition, the racks are telescopically carried by support housings in such a manner as to be extended or cantilevered outwardly from a normally out-of-the-way storage position to a position where access to articles carried by the racks is facilitated. The racks are also carried by their support housing in such a manner that the articles carried by the racks are protected from being accidentally dislodged by interference with adjacent objects or articles supported or stored in relatively close proximity thereto in an area such as a closet or wardrobe.

2. History of the Art

Heretofore, there have been many structures which have been developed to facilitate the organization of closets and/or storage spaces. Many of these concepts have utilized various modified hangers which may utilized in a closet or wardrobe in order to support varying articles of clothing or clothing accessories.

In U.S. Pat. Nos. Des. 277,248, 277,436, 280,045, 280,046, 280,047, 280,048, 280,049, 280,575, 280,785, all to Benedict, a number of configurations are shown for tie and belt racks which are designed to organize the storage of ties and belts. The racks are carried by telescoping housings in such a manner that they are normally positioned beneath the clothing support rod of a closet and yet are selectively movably outwardly of the support rod so that access to the articles carried by the racks may be facilitated. In addition, in U.S. Pat. No. 4,585,127 to Benedict, the extendable concept was further utilized to enable a plurality of clothing support bags to be movably disposed within a closet or wardrobe so as to facilitate the placement and/or selection of articles from such bags.

Other prior art devices have also been designed to enable a plurality of items to be stored on a single carrier thereby making it possible for a plurality of clothing articles to be stored in one area and yet separately spaced with respect to one another so that selection of a particular article of clothing is facilitated.

Many of the prior art structures including those discussed above have had somewhat limited usefulness in that they were primarily designed to support generally specific articles such as relatively narrow ties, belts, bands, chains and the like. In view of the foregoing, wider articles of clothing accessories such as scarfs could not be neatly organized utilizing such structures. Generally, the supporting surfaces provided by multiple article support racks have not been of sufficient width to permit wider clothing accessories including scarfs to be neatly stored thereon while simultaneously providing support for other narrow articles. Many of the prior art racks, although providing a plurality of clothing or article support hooks, carried such support hooks along a central support rod in such a way that the rod effectively divided each of the supporting elements into half sections thus restricting or limiting the placement of larger articles thereon.

Some other examples of the prior art include U.S. Pat. Nos. 2,569,761 to Hibbs, 2,917,185 to Kovacs, 2,985,311 to Abel, 3,124,253 to Petrich, 3,160,279 to Hovey, 3,335,872 to Dodich, 3,389,807 to Manning et al., 3,897,122 to McEvers and 3,954,182 to McEvers.

SUMMARY OF THE INVENTION

This invention is generally directed to extendable closet organizers for use in supporting a plurality of articles or clothing accessories such as scarfs, beads, chains, belts, handbags and the like and in which each closet organizer includes a support rack having a plurality of generally horizontally oriented support bars which are carried by an elongated rod member suspended from a telescoping housing. The rod member and the support bars of the racks are selectively cantilevered outwardly with respect to an overlying surface to which the telesoping housing is mounted. The support racks include a plurality of generally C-shaped bar elements having vertically spaced upper and lower support bars which are integrally connected at one end and which are suspended from the rod element which is carried by the telescoping housing. The housing includes outwardly extending flanged portions which are oriented generally parallel to a closet support rod or other surface from which the extendable or telescoping housing is mounted. The flanged portions of the housing maintain the racks in spaced relationship to other articles which may be stored or suspended in proximate relationship thereto. To further insure that there is no interference between other articles which may be suspended in close proximity to the support racks of the present invention, the generally C-shaped bar elements are of a width which is generally equal to or less than the outer extend dimensions of the flanged portions of the telescoping housing. In this manner, the articles supported thereon will be stored in vertically spaced relationship below the flanged portion of the housing thereby insuring that such articles will not be interfered with by adjacent articles within a closet or wardrobe.

The lower support bar of each of the C-shaped article support elements extends substantially the full width of the flanged portions of the telescoping housing thereby providing an elongated supporting surface upon which wide articles of clothing such as scarfs and the like may be easily and neatly suspended. The outermost end portions of each of the lower support bars is configured so as to provide an upwardly extending projection which serves to restrain articles from accidentally sliding off the support bars.

The upper support bars may extend the full width defined by the outwardly extending flanged portions of the telescoping housings or may be of half that size as shown by different embodiments of the invention. As the upper support bars are mounted to the central rod members of the article support racks, even though the upper bars extend the full width as defined by the flanged portion of the housing, such bars will be divided generally into two sections. In order to prevent articles from being accidentally displaced relative to the upper support bars, the outer free ends thereof may be upwardly inclined.

The upper and lower support bars are integrally connected by a U-shaped end portion which portion may be formed so that the upper support bars are vertically inclined in an upward direction as they extend outwardly of the central rod member. In this manner, the end portions also function to resist the accidental displacement of articles from the support bars.

As shown in several embodiments of the invention, the free ends of either the upper or lower support bars may include a hooked or depressed section for facilitating the placement of belts and other articles thereby permitting the support bars to simultaneously carry varying types and sizes of articles or clothing accessories.

It is a primary object of this invention to provide extendable article support racks for clothing accessories including scarfs, chains, ties, belts, handbags and the like wherein the support racks provide a plurality of spaced upper and lower support surfaces upon which a variety of such clothing accessories may be simultaneously supported.

It is also an object of the present invention to provide article support racks which may be supported from extendable support housings wherein the housings are provided with outwardly extending flanged portions which overly the bars carried by the support racks so the articles carried thereby may be vertically suspended without interference from adjacent articles which may be stored in proximate relationship to the article support racks.

It is yet another object of the present invention to provide extendable closet organizers having support racks which include a plurality of generally C-shaped clothing accessory support bars whereby a plurality of varying sizes and types of clothing accessories may be suspended on common supporting elements.

It is another object of the present invention to provide extendable article supports or organizers for use in closets and wardrobes and the like wherein a plurality of article support bars are mounted in horizontally spaced relationship and which are movable from an out of the way position to a position to be easily accessed and wherein the article support rods are configured at their outer ends so as to provide restraining or stop means to prevent the accidental displacement of articles laterally with respect thereto.

It is a further object of the present invention to provide extendable or telescoping closet organizers having a plurality of generally C-shaped article support bars arranged in horizontally spaced relationship with respect to one another so that rows of upper and lower support elements are created and wherein the lower support elements may be utilized to suspend articles that are too wide to be carried by the upper support elements and thereby such clothing accessories as wide scarfs and the like may be suspended or stored together with narrow articles of clothing or clothing accessories such as chains, belts, ties and the like.

BRIEF DESCRIPTION OF THE DRAWINGS

FIG. 1 is a partial elevational view of one embodiment of the article support racks of the present invention showing a plurality of spaced support bars or elements which are oriented in generally horizontal relationship with respect to one another.

FIG. 2 is a cross sectional view taken along lines 2—2 of FIG. 1.

FIG. 3 is a cross sectional view similar to that of FIG. 2 showing a first modified form of support bar elements.

FIG. 4 is a cross sectional view similar to that of FIG. 2 showing a second modified form of support bar elements wherein the upper support bars are upwardly inclined along their length.

FIG. 5 is a cross sectional view similar to that of FIG. 2 showing a third modified form of support bar elements where the upper support bars are generally coextensive with the lower support bars.

DESCRIPTION OF THE PREFERRED EMBODIMENT

Figure 7:
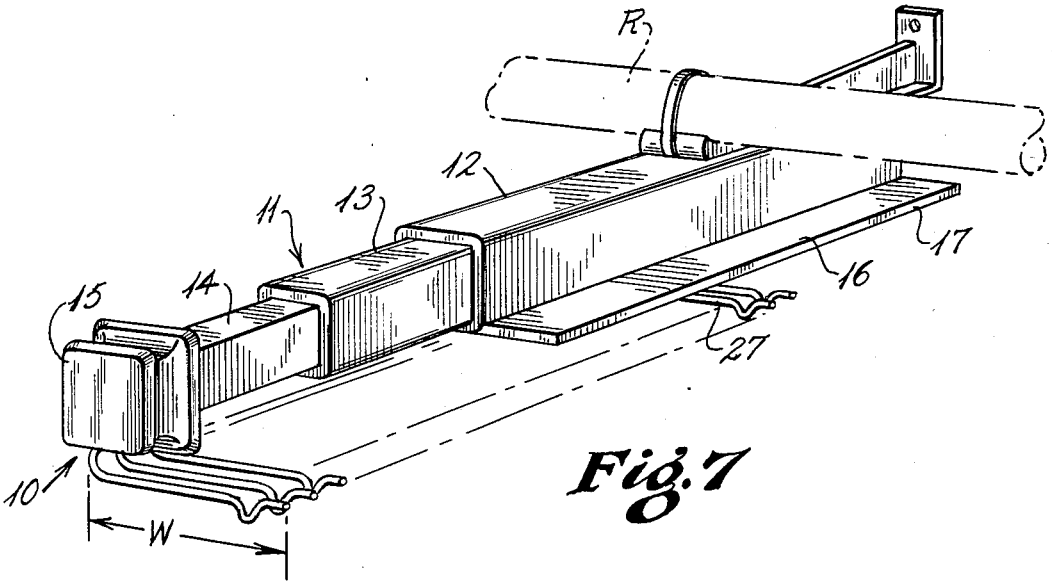
FIG. 7 is a perspective illustrational view of the support rack of FIG. 2 as it is carried by the telescoping housing of the present invention and suspended from the clothes rod in a closet or wardrobe.

An article support rack 10 of the present invention is shown in FIG. 7 as being carried by a telescoping housing 11 which is mounted by a suitable mounting arrangement to a clothes support rod R which is conventionally found in a closet or wardrobe. It should be noted that the housing 11 may be supported to the underside of other supporting surfaces such as a shelf or overhang with the mounting components being altered to accommodate the suspension of the housing from such supporting surfaces. The telescoping housing 11 is shown as having a primary body or section 12 which is mounted in fixed relationship with respect to the clothing support rod or other support surface. Extendably carried within the main or primary housing section 12 is an intermediate slider member 13 and an innermost slide member 14. The telescoping members 13 and 14 are slidably moved with respect to the primary body or section 12 by either pulling or pushing on the outer handle or knob 15 which is secured to the outermost end portion of the innermost slider or telescoping member 14.

Each of the housing sections 12, 13 and 14 are shown as being of a rectangular tubular configuration with the intermediate member 13 being slidably received within the primary housing body 12 and the inner member 14 being slidably received within the intermediate member 13. For purposes of the present invention, it is envisioned that other configurations of extendable housing sections may be utilized. In addition, although two telescoping members are shown in the drawings, the number of telescoping members may be increased or reduced and still provide the necessary utility for moving the article support rack 10 in a horizontal direction relative to a vertically oriented supporting surface.

Attached to and extending outwardly on either side of the primary housing section 12 are a pair of outwardly oriented flange members 16 which extend along the entire length of the primary section. The outwardly extending flange members 16 not only provide a cover for underlying articles which will be selectively mounted or carried by the article support rack 10 but also will insure that adjacent articles suspended from the closet support rod or other supporting surface are maintained in spaced relationship to the articles carried by the support rack 10. In this manner, it is envisioned that the width W of the support rack 10 will be equal to or less than the width defined between the outer edges 17 of the flange members 16.

The article support rack 10 of the present invention is shown in a first embodiment in FIG. 1 as having a suspension or hanger rod 20 having a central elongated section 21 and outermost upwardly extending mounting posts 22 and 23. The hanger rod 20 is generally the same length as the inner telescoping slide member 14 of the housing 11 and the upstanding end portions 22 and 23 are mounted within the front and rear portions of the inner telescoping member 14. As the hanger rod member 20 is carried by the inner telescoping member, the entire article support rack 10 will be movably carried with the inner telescoping member 14 as it is maneuvered with respect to the central body portion 12 of the telescoping housing 11.

The article support rack 10 includes a plurality of generally C-shaped support members 25 which are mounted to the central portion 21 of the hanger element 20 so as to be in generally equally spaced relationship with respect to one another along the length thereof. Each of the C-shaped article support members includes an upper and lower article support bar 26 and 27, respectively, which are integrally connected at one end by a U-shaped portion 28. As shown, the upper support bar 26 is welded or otherwise attached to the central portion 21 of the hanger rod 20 so that the lower article support bar 27 extends in spaced vertical relationship beneath the central portion 21. The number of article support members 25 may be varied depending upon the types of articles to be suspended from the article support rack, and therefore, the spacing therebetween may be adjusted accordingly.

The article support members 25 are shown in greater detail in FIG. 2 with various embodiments thereof being shown in FIGS. 3–6. With particular reference to FIG. 2, the article support members shown at FIG. 1 are shown in enlarged front plan view. Each of the article support members includes the upper support bar 26 and lower support bar 27 and innerconnecting U-shaped portion 28. The outer end 29 of the upper support bar 26 is shown as terminating generally in alignment with the central portion 21 of the hanger member 20. The outer portion 30 of the lower support bar 27 is shown as being extended outwardly generally perpendicularly with respect to the vertically spaced central rod portion 21 of the hanger member 20. A recessed or U-shaped area 32 is provided along the outer portion 30 and is spaced inwardly from the outermost end 33 thereof. The outermost end 33 is shown as being upwardly oriented with respect to the major portion of the lower support bar 27. The area between the ends 29 and 33 of the upper and lower support bars 26 and 27, respectively, is open so as to permit articles to be selectively positioned over the lower support bar 27 without interference with the upper support bar 26 or hanger member 20. The outer U-shaped portion 32 of the lower support bar 27 not only provides a suspension area for such articles as belts, chains and the like, but the upwardly extending end portion 33 of the lower bar element 27 also serves as a stop or restraining element for preventing articles from being slidably urged outwardly with respect to the support bar 27 when they are mounted thereon.

It should be noted that the configuration of article support members 25 shown in FIG. 2 provides an unique balancing with respect to a variety of clothing accessories which may be carried or stored on the support rack. Specifically, the central portion 34 of the lower bar element 27 provides an elongated surface upon which such articles as wide scarfs and ties and the like may be selectively suspended while somewhat narrower ties and the like may be suspended from the upper support bar 26. When utilizing only the upper support bar 26 and the central portion 34 of the lower support bar 27, the loads are positioned so that the weight is directed to the left side of an axis defined along the central portion 21 of the hanger rod member 20. This weight may be offset on the opposite side of the axis by suspending belts or chains and the like within the recessed portion 32 formed in the outer end portion 30 of the lower support bar 27. In this manner, a balanced load may be suspended from each of the support members thereby insuring that the load carried by the extendable housing is equally distributed on either side thereof. As discussed above, the distance between the outer extreme of the U-shaped portion 28 between the upper and lower support bars and the outer end 33 of the lower support bar element is of a dimension W which is equal to or less than the overall width as taken between the outer edges 17 of the flanges of the main body section of the support housing. In addition, the intermediate U-shaped portion 28 functions to provide a restraining element for preventing the shifting of articles carried on the lower support bar element 27 to the left of the support elements as shown in FIG. 2.

A modified form of support members 25 is shown in FIG. 3. In this embodiment, the innerconnecting portion 28 between the upper and lower support bars 26 and 27 is shown as being semi-circular in configuration so that the uppermost portion thereof shown at 37 is positioned above the upper support bar element 26. In this manner, an upwardly tapered or inclined area 38 is formed integrally between the semi-circular portion 36 and the support rod element 26. This upwardly inclined area 38 provides a positive restraint for preventing articles carried on the upper support rod 26 from being accidentally displaced outwardly with respect thereto.

As opposed to the semi-circular configuration for the intermediate member, the support members 25 may be modified, as shown in FIG. 4, by inclining the upper support bar element 26. This incline is shown as being gradual from the outer or free end 29 thereof upwardly to the U-shaped connecting portion 28. The slope of the upper bar 26 toward the central support rod 21 will have a tendency to urge articles carried thereon toward the central support rod thereby preventing their accidental displacement relative thereto as the article support rack is maneuvered relative to the housing 11.

A further embodiment of the invention is shown in FIG. 5 wherein the article support members 25 are modified so that the upper support bar 26 has an outwardly extending portion 40 which overlies and is generally coextensive with the underlying outer end portion 30 of the lower support bar 27. The outer extending portion 40 is integrally formed with the remaining portion of the support bar 26 and may include an upwardly extending outer end 42 for purposes of providing a barrier for preventing the accidental displacement of an article carried on the extended portion 40 of the upper support bar in a manner similar to that previously described with respect to the upwardly extending outer end 33 of the lower support bar element 27. As with the prior embodiments, the intermediate portion 28 between the upper and lower support bars may be selectively configured as shown in FIG. 3 or 4 so that articles carried on the inner portion of the upper support bar are also restrained from being accidentally displaced outwardly with respect thereto.

Figure 6:
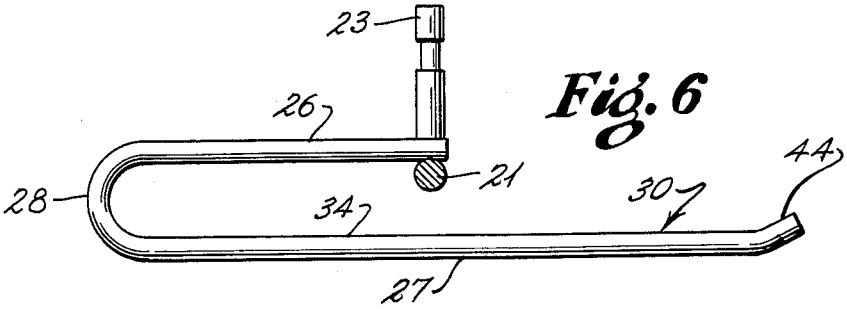
FIG. 6 is a cross sectional view similar to that of FIG. 2 showing a fourth modified form of support bar elements wherein the lower support bars have a modified free end configuration.

Another embodiment of the article support members of the present invention is shown in FIG. 6. In this embodiment of the invention, the outer end portion 30 of the lower support bar 27 has been modified by removing the U-shaped or recessed end portion 32 thereof and instead providing an upturned end portion as shown at 44. With this configuration, there is greater planar supporting surface along the width of the article support bar 27 with the upturned end portion thereof providing an abutment surface for preventing the accidental lateral displacement of articles carried thereby. As with the prior embodiment, the intermediate U-shaped portion may be modified in shape as discussed above with respect to FIGS. 3 and 4 or further modified as shown in FIG. 5 so as to make the upper support bar coextensive with the lower support bar.

In the use of the article support racks of the present invention, the racks are mounted to the innermost telescoping member 14 of the telescoping housing 11 so as to be horizontally extendable therewith as the inner telescoping member is moved relative to the main support housing 12. The shape of the article support members 25 is such as to insure a plurality of varying widths of clothing accessories may be carried by the upper and lower support bars. Depending upon the modification of support members being utilized, either one or two articles may be suspended on the upper support bars 26 with such articles being positioned on either side of the central support rod 21 of the hanger member 20. Articles are securely retained and restricted from accidental displacement with respect to the upper support bars by providing upwardly inclined surfaces adjacent each end thereof as described above with respect to the several embodiments. The lower support bar can be utilized to support wider articles of clothing and simultaneously may be used to suspend chains or belts from the recessed areas 32 thereof. In this manner, a plurality of varying sizes and types of clothing and clothing accessories may be carried by each of the support members with the support members insuring that loads may be selectively balanced with respect to the telescoping housing in which the article support rack is mounted.

We claim:

1. An extendable closet organizer comprising a housing having a primary section and at least one slider member extendably carried by said primary section so as to be cantilevered outwardly with respect thereto, an article support rack means carried by said slider member, said article support rack means having a hanger means having an elongated central rod portion which extends generally parallel to and in vertically spaced relationship to said slider member and at least one upstanding element mounted to said slider member, a plurality of generally C-shaped support members attached to said central rod portion of said hanger means, each of said support members including upper and lower article support bars having first and second ends and intermediate sections, said second ends of said support bars being integrally connected by an interconnecting section, said upper support bars being connected to and extending outwardly with respect to said central rod portion of said hanger means, each of said upper and lower support bars being vertically spaced below said slider member and said lower support bar being vertically spaced below said central rod portion of said hanger means, said first and second ends of said lower support bars being generally equally spaced outwardly with respect to the elongated axis of said central rod portion of said hanger means, said intermediate sections of said upper and lower support bars being generally parallel with respect to one another and being generally horizontally oriented and said lower support bar being upwardly inclined adjacent said first end thereof whereby articles may be selectively carried by each of said upper and lower support bars.

2. The extendable closet organizer of claim 1 in which said primary section of said housing includes a pair of outwardly extending flanges which extend along substantially the entire length and on opposite sides thereof, said flanges having outermost edges defining a predetermined dimension, said upper and lower bars of said support member having a maximum length equal to or less than said predetermined dimension.

3. The extendable closet organizer of claim 1 in which said first end of each of said upper support bars is generally coextensive with said first end of said lower support bars.

4. The extendable closet organizer of claim 1 in which said first end of each of said upper support bars is generally coextensive with said first end of said lower support bars.

5. The extendable closet organizer of claim 4 in which each of said upper support bars is inclined upwardly adjacent the first end thereof.

6. The extendable closet organizer of claim 1 in which each of said lower support bars includes a depressed section adjacent said first end thereof.

7. The extendable closet organizer of claim 6 in which said interconnecting sections of each of said support members extends upwardly beyond said upper support bar to thereby provide a restraining surface for preventing articles from being removed with respect to said upper support bar.

8. The extendable closet organizer of claim 1 in which said lower support bar of at least one of said support members includes a depressed section spaced inwardly of said first end thereof.

9. The extendable closet organizer of claim 1 in which said upper support bar of at least one of said support members is generally coextensive with said lower support bar thereof.

10. The extendable closet organizer of claim 1 in which said upper support bar of at least one of said support members includes and upwardly inclined portion adjacent the second end thereof.

11. The extendable closet organizer of claim 1 in which said upper support bar is tapered slightly upwardly along its length from said central portion of said hanger means to said interconnecting section.

12. The extendable closet organizer of claim 1 in which said interconnecting section of at least one of said support members is generally semi-circular in configuration having uppermost portions which extend above said upper support bar.

* * * * *